US009857103B2

(12) United States Patent
Lee et al.

(10) Patent No.: US 9,857,103 B2
(45) Date of Patent: Jan. 2, 2018

(54) REFRIGERATOR HAVING A CONDENSATION LOOP BETWEEN A RECEIVER AND AN EVAPORATOR

(71) Applicant: LG ELECTRONICS INC., Seoul (KR)

(72) Inventors: Sangbong Lee, Seoul (KR); Jangseok Lee, Seoul (KR); Hyoungkeun Lim, Seoul (KR); Myungjin Chung, Seoul (KR); Minkyu Oh, Seoul (KR); Youngsu Jeong, Seoul (KR); Younggyu An, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 351 days.

(21) Appl. No.: 14/531,426

(22) Filed: Nov. 3, 2014

(65) Prior Publication Data

US 2015/0121918 A1 May 7, 2015

(30) Foreign Application Priority Data

Nov. 4, 2013 (KR) ..... 10-2013-0133028
Mar. 21, 2014 (KR) ..... 10-2014-0033317

(51) Int. Cl.
*G05D 23/32* (2006.01)
*F25B 5/02* (2006.01)
(Continued)

(52) U.S. Cl.
CPC ..... *F25B 5/02* (2013.01); *F25B 40/02* (2013.01); *F25B 43/003* (2013.01);
(Continued)

(58) Field of Classification Search
CPC ..... F25B 2400/053; F25B 47/022; F25B 2347/021; F25B 2347/00; F25B 2347/02;
(Continued)

(56) References Cited

U.S. PATENT DOCUMENTS 3,135,316 A 6/1964 Foster et al.
3,427,819 A * 2/1969 Seghetti ..... F25B 5/02 62/196.4
(Continued)

FOREIGN PATENT DOCUMENTS

DE 1 601 014 A1 5/1970
EP 2 530 394 A1 12/2012
(Continued)

OTHER PUBLICATIONS

European Search Report dated May 8, 2015 issued in Application No. 14191510.8.
(Continued)

*Primary Examiner* — Frantz Jules
*Assistant Examiner* — Filip Zec
(74) *Attorney, Agent, or Firm* — KED & Associates, LLP

(57) ABSTRACT

The refrigerator includes a compressor compressing a refrigerant, a condenser condensing the refrigerant compressed in the compressor, and a dryer in which the refrigerant condensed in the condenser is introduced. The dryer removes impurities or moisture of the refrigerant. A flow adjustment part is provided on an outlet-side of the dryer to switch or control a flow direction of the refrigerant. A plurality of evaporators is connected to the flow adjustment part, and the plurality of evaporators includes a first evaporator and a second evaporator. A first refrigerant passage extends from the flow adjustment part to the first evaporator, and a second refrigerant passage extends from the flow adjustment part to the second evaporator. A guide tube extends from the dryer to one side of at least one evaporator of the plurality of evaporators to guide the refrigerant to be cooled.

15 Claims, 11 Drawing Sheets

(51) Int. Cl.

| | |
|---|---|
| ***F25B 40/02*** | (2006.01) |
| ***F25B 43/00*** | (2006.01) |
| *F25D 23/02* | (2006.01) |
| *F25D 11/02* | (2006.01) |
| *F25D 21/04* | (2006.01) |

(52) U.S. Cl.
CPC ..... *F25B 2400/05* (2013.01); *F25B 2600/01* (2013.01); *F25B 2600/2511* (2013.01); *F25B 2700/02* (2013.01); *F25D 11/022* (2013.01); *F25D 21/04* (2013.01); *F25D 23/02* (2013.01)

(58) Field of Classification Search
CPC .... F25B 2400/16; F25D 11/022; F25D 21/06; F25D 21/065; F25D 21/04
See application file for complete search history.

(56) References Cited

U.S. PATENT DOCUMENTS

| | | | | | |
|---|---|---|---|---|---|
| 3,645,109 | A * | 2/1972 | Quick | F25B 1/00 | 62/196.2 |
| 3,984,223 | A * | 10/1976 | Whistler, Jr. | F25D 21/04 | 62/277 |
| 4,522,037 | A * | 6/1985 | Ares | F25B 5/02 | 62/196.4 |
| 4,918,942 | A * | 4/1990 | Jaster | F25B 1/10 | 62/335 |
| 5,157,941 | A | 10/1992 | Cur et al. | | |
| 5,212,965 | A | 5/1993 | Datta | | |
| 5,243,837 | A | 9/1993 | Radermacher et al. | | |
| 6,185,957 | B1 | 2/2001 | Voss et al. | | |
| 6,289,691 | B1 | 9/2001 | Kim et al. | | |
| 6,615,610 | B1 * | 9/2003 | Pettitt | B60H 1/00571 | 62/474 |
| 6,705,107 | B2 * | 3/2004 | Schlosser | F25B 5/02 | 62/344 |
| 6,758,054 | B2 | 7/2004 | Zheng et al. | | |
| 8,479,527 | B2 * | 7/2013 | Song | F25B 5/04 | 62/151 |
| 2006/0266075 | A1 | 11/2006 | Itsuki et al. | | |
| 2007/0199335 | A1 | 8/2007 | Innes | | |
| 2008/0035318 | A1 | 2/2008 | Kamaida et al. | | |
| 2008/0190125 | A1 | 8/2008 | Yoshioka et al. | | |
| 2010/0043475 | A1 | 2/2010 | Taras et al. | | |
| 2013/0312437 | A1 * | 11/2013 | Davies | F25B 47/02 | 62/81 |

FOREIGN PATENT DOCUMENTS

| | | | |
|---|---|---|---|
| JP | 2001-124454 | A | 5/2001 |
| KR | 10-2006-0069654 | A | 6/2006 |
| KR | 10-2007-0027262 | A | 3/2007 |
| KR | 10-2008-0107176 | A | 12/2008 |
| KR | 10-2012-0054346 | A | 5/2012 |
| KR | 10-2013-0088430 | A | 8/2013 |
| WO | WO 2012/128610 | A1 | 9/2012 |

OTHER PUBLICATIONS

European Search Report dated Aug. 24, 2015 issued in Application No. 14191510.8.
Korean Office Action dated Aug. 11, 2015 issued in Application No. 10-2014-0033317.
United States Office Action dated Feb. 1, 2017 issued in U.S. Appl. No. 14/531,223.

* cited by examiner

REFRIGERATOR HAVING A CONDENSATION LOOP BETWEEN A RECEIVER AND AN EVAPORATOR

CROSS-REFERENCE TO RELATED APPLICATIONS

This application claims priority under 35 U.S.C. §119 to Korean Application Nos. 10-2013-0133028 filed on Nov. 4, 2013 and No. 10-2014-0033317 filed on Mar. 21, 2014, whose entire disclosures are incorporated herein by reference.

BACKGROUND

1. Field

The present disclosure relates to a refrigerator and a method for controlling the same.

2. Background

In general, a refrigerator has a plurality of storage compartments for accommodating food to be stored so as to store the food in a frozen or refrigerated state. The storage compartment may have one surface that is opened to receive or allow the retrieval of the food. The plurality of storage compartments include a freezing compartment for storing food in the frozen state and a refrigerating compartment for storing food in the refrigerated state.

A refrigeration system in which a refrigerant is circulated is driven in the refrigerator. The refrigeration system may include a compressor, a condenser, an expansion device, and an evaporator. The evaporator may include a first evaporator disposed at a side of the refrigerating compartment and a second evaporator disposed at a side of the freezing compartment.

Cool air stored in the refrigerating compartment may be cooled while passing through the first evaporator, and the cooled cool air may be supplied again into the refrigerating compartment. The cool air stored in the freezing compartment may be also cooled while passing through the second evaporator, and the further cooled cool air may be supplied again into the freezing compartment.

In the refrigerator according to the related art, independent cooling may be performed in the plurality of storage compartments through separate evaporators. A refrigerant introduced into the first and second evaporators may be decompressed by the expansion device to change into a two-phase refrigerant, for example, a two-phase refrigerant having a relatively high dryness fraction, thereby deteriorating heat-exchange efficiency in the first and second evaporators.

The refrigerant may be also selectively supplied into the first or second evaporator according to a cooling operation mode, i.e., whether the refrigerating or freezing compartment cooling operation is performed. A phenomenon in which an amount of refrigerant circulating into the refrigeration cycle is lacking or insufficient according to operation mode conditions may occur.

In recent years, a refrigerator in which a storage compartment increases in capacity to receive a large amount of food in the storage compartment has become a trend. To effectively cool the storage compartment having large capacity, it may be necessary to manufacture a large condenser. However, there is manufacturing limit to a condenser having a size greater than a preset size in a situation in which the total size of the refrigerator is limited within a preset range.

As a result, in case of the refrigerator having the condenser that is limited in size, it may be difficult to secure sufficient condensation capacity, and thus, operation efficiency may be deteriorated.

BRIEF DESCRIPTION OF THE DRAWINGS

The embodiments will be described in detail with reference to the following drawings in which like reference numerals refer to like elements wherein.

DETAILED DESCRIPTION OF THE EMBODIMENTS

Figure 1:
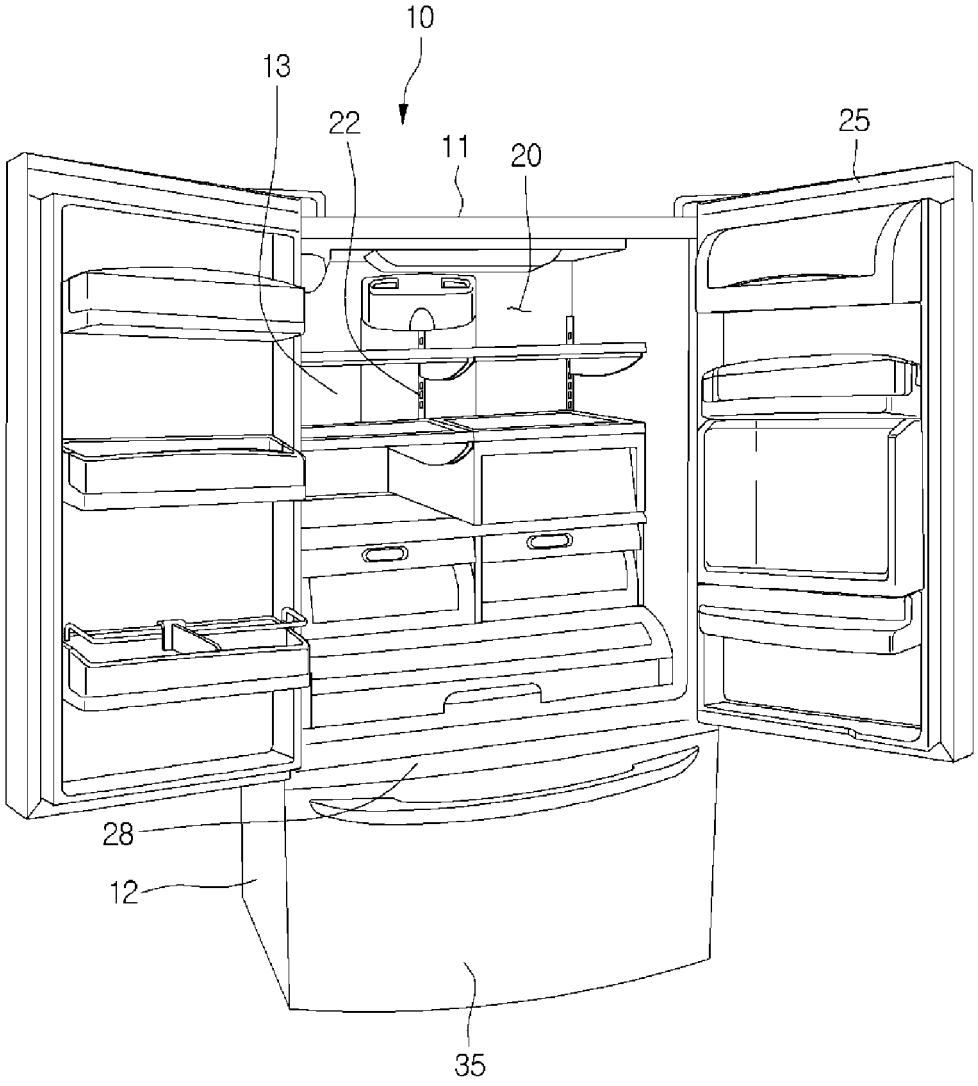
FIG. 1 is a perspective view of a refrigerator according to a first embodiment.
Figure 2:
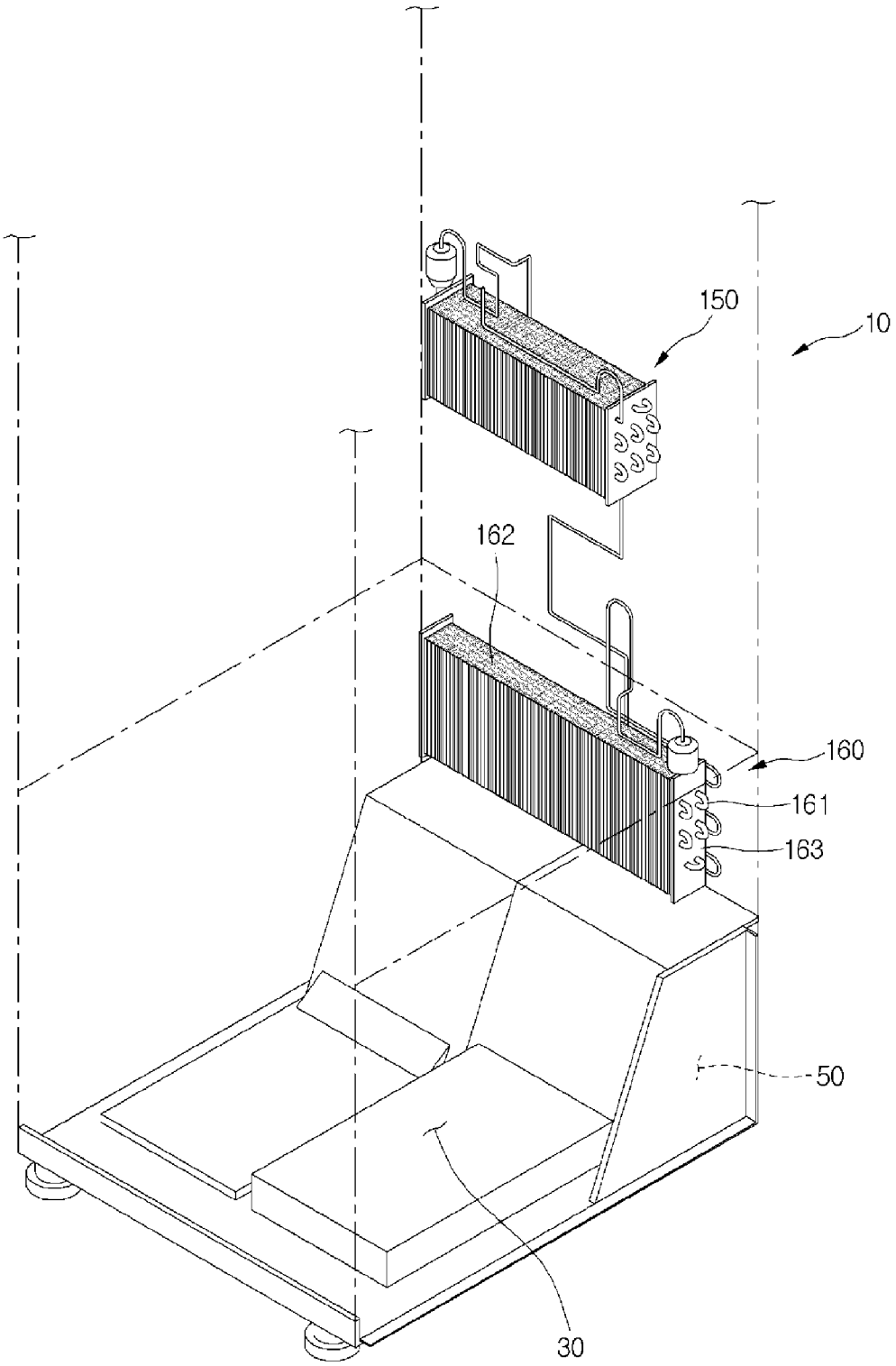
FIG. 2 is a view illustrating a portion of constitutions of the refrigerator according to the first embodiment.
Figure 3:
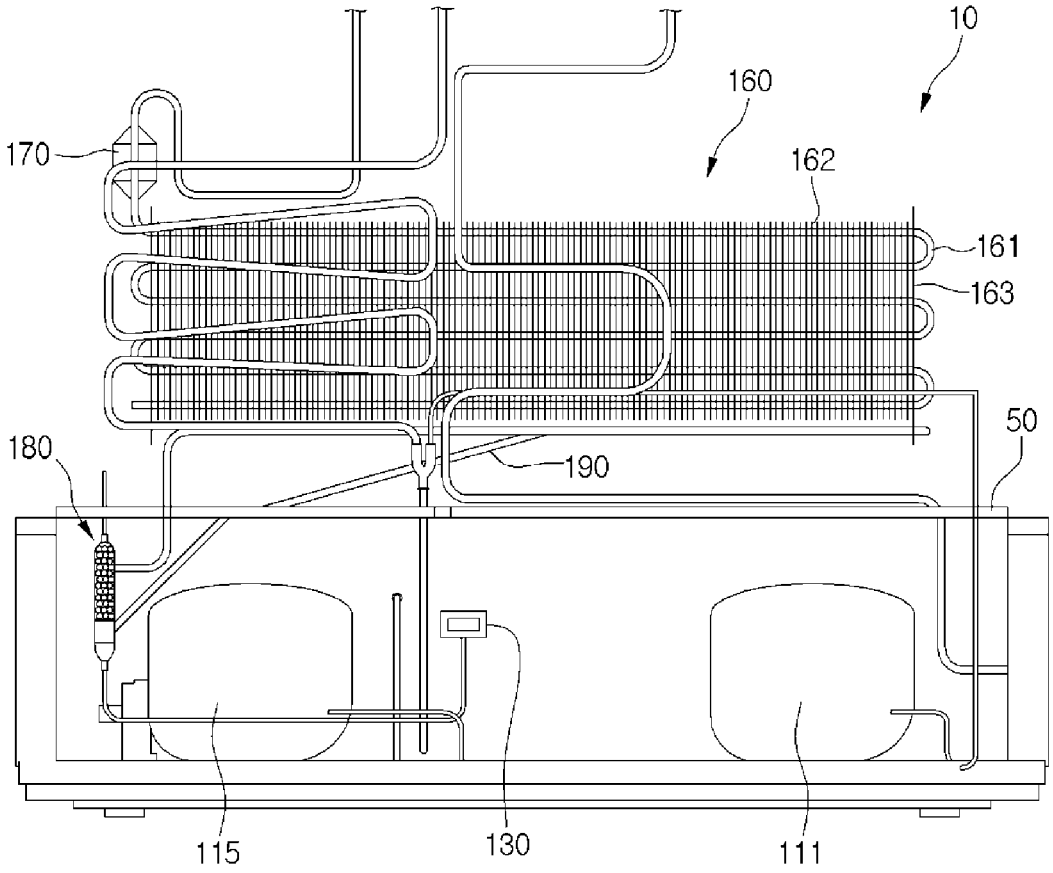
FIG. 3 is a rear view of the refrigerator according to the first embodiment.

FIG. 1 is a perspective view of a refrigerator according to a first embodiment, FIG. 2 is a view illustrating a portion of constitutions of the refrigerator according to the first embodiment, and FIG. 3 is a rear view of the refrigerator according to the first embodiment. A refrigerator 10 may include a main body 11 defining a storage compartment. The storage compartment includes a refrigerating compartment 20 and a freezing compartment 30. For example, the refrigerating compartment 20 may be disposed above the freezing compartment 30. However, the present disclosure is not limited to the positions of the refrigerating compartment 20 and the freezing compartment 30. The refrigerating compartment and the freezing compartment may be partitioned by a partition wall 28.

The refrigerator 10 includes a refrigerating compartment door 25 for opening or closing the refrigerating compartment 20 and a freezing compartment door 35 for opening or closing the freezing compartment 30. The refrigerating compartment door 25 may be hinge-coupled to the main body 10 to rotate, and the freezing compartment door 35 may be provided in a drawer type and thus be withdrawable forward. Alternatively, if the freezing compartment is provided above the refrigerating compartment, hinged doors may be used for both compartments.

The main body 11 includes an outer case 12 defining an exterior of the refrigerator 10 and an inner case 13 disposed inside the outer case 12 to define at least one portion of an inner surface of the refrigerating compartment 20 or freezing compartment 30.

A cool air discharge part or openings 22 for discharging cool air into the refrigerating compartment 20 may be disposed in a rear wall of the refrigerating compartment 20. Although not shown, a cool air discharge part for discharging cool air into the freezing compartment 30 may be disposed in a rear wall of the freezing compartment 30.

The refrigerator 10 includes a plurality of evaporators 150 and 160 for independently cooling the refrigerating compartment 20 and the freezing compartment 30. The plurality of evaporators 150 and 160 include a first evaporator 150 for cooling one storage compartment of the refrigerating compartment 20 and a second evaporator for cooling the freezing compartment 30. Since the refrigerating compartment 20 is disposed above the freezing compartment 30 in the current embodiment, the first evaporator 150 may be disposed above the second evaporator 160.

The first evaporator 150 may be disposed at a rear side of the rear wall of the refrigerating compartment 20, and the second evaporator 160 may be disposed at a rear side of the rear wall of the freezing compartment 30. The cool air generated in the first evaporator 150 may be supplied into the refrigerating compartment 20 through the refrigerating compartment cool air discharge part 22, and the cool air generated in the second evaporator 160 may be supplied into the freezing compartment 30 through the freezing compartment cool air discharge part.

The second evaporator 160 includes a refrigerant tube 161 in which the refrigerant flows, a fin 162 coupled to the refrigerant tube 161 to increase a heat-exchange area between the refrigerant and the fluid, and a fixing bracket 163 fixing the refrigerant tube 161. The fixing bracket 163 may be provided in plurality on both sides of the refrigerant tube 161.

The refrigerant tube 161 may be bent in one direction and the other direction. The fixing brackets 163 may be fixed to both sides of the refrigerant tube 161 to prevent the refrigerant tube from being shaken. For example, the refrigerant tube 161 may be disposed to pass through the fixing bracket 163. The fin 162 may be provided in plurality. The plurality of fins 162 may be spaced apart from each other, and the refrigerant tube 161 may pass through the plurality of fins 162.

A gas/liquid separator 170 for filtering a liquid refrigerant of the refrigerant evaporated in the second evaporator 160 to supply a gaseous refrigerant into second compressor 115 may be disposed at a side of the second evaporator 115.

The first evaporator 150 may have constitutions similar to those of the second evaporator 160. Although separate reference numerals are not given, the first evaporator 150 may include the refrigerant tube, the fin, and the fixing bracket, which are described above. Also, the other gas/liquid separator may be disposed on one side of the first evaporator 150.

A machine room 50 in which main components of the refrigerator are disposed may be defined in a rear lower portion of the refrigerator 10, i.e., a lower portion of a rear side of the freezing compartment 30. For example, the compressor and the condenser are disposed in the machine room 50.

In detail, referring to FIG. 3, the plurality of compressors 111 and 115 for compressing the refrigerant and the condenser (see reference numeral 120 of FIG. 6) for condensing the refrigerant compressed in the plurality of compressors 111 and 115 are disposed in the machine room 50. A flow adjustment part or valve 130 that adjusts a flow direction of the refrigerant to supply the refrigerant into the first and second evaporators 150 and 160 may be disposed in the machine room 50. A dryer 180 for removing moisture or impurities contained in the refrigerant condensed in the condenser 120 may be disposed in the machine room 50. The dryer 180 may temporally store the liquid refrigerant introduced therein.

The refrigerator 10 further includes a guide tube 190 extending from the dryer 180 to the second evaporator 160 to guide the flow of the refrigerant. The guide tube 190 may extend from the dryer 180 within the machine room 50 to the outside of the machine room 50 and then be fixed to one side of the second evaporator 160. For example, the guide tube 190 may be coupled to the fixing bracket 163. For example, the guide tube 190 may have both sides that are fixed by the fixing bracket 163.

The guide tube 190 may be disposed adjacent to the second evaporator 160. Since a low-temperature refrigerant flows into the refrigerant tube 161, the surrounding of the second evaporator 160 may be under a low temperature. Thus, the refrigerant flowing into the guide tube 190 may be cooled (condensed) while flowing adjacent to the second evaporator 160. Particularly, if the refrigerant flowing into the guide tube 190 is a gaseous refrigerant, the gaseous refrigerant may change in phase into a liquid refrigerant while flowing around the second evaporator 160. As another example, the guide tube 190 may be disposed to directly contact the refrigerant tube 161.

Figure 4:
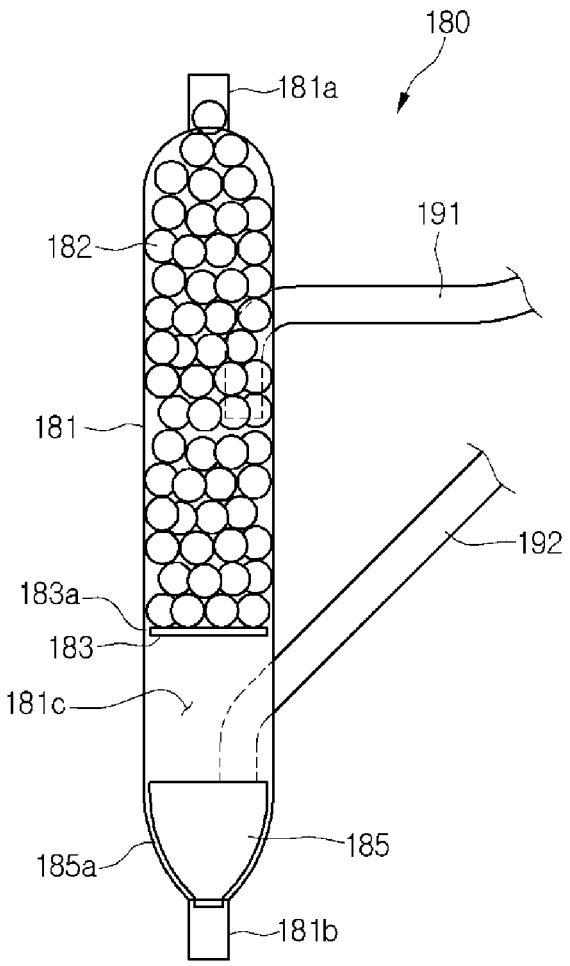
FIG. 4 is a view illustrating a configuration of a dryer according to the first embodiment.
Figure 5:
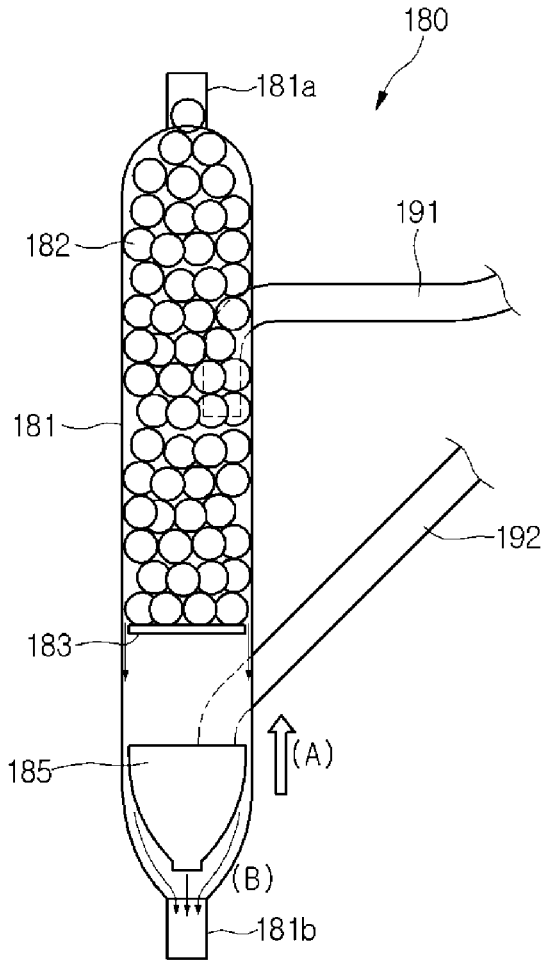
FIG. 5 is a view illustrating an effect of a dryer according to the first embodiment.

FIG. 4 is a view illustrating a configuration of the dryer according to the first embodiment, and FIG. 5 is a view illustrating an effect of the dryer according to the first embodiment. The dryer 180 includes a dryer body 181 defining an inner space thereof, an inflow hole 181*a* defined in an upper portion of the dryer body 181 to introduce the refrigerant condensed in the condenser 120, i.e., the two-phase refrigerant therein, and a discharge hole 181*b* defined in a lower portion of the dryer body 181 to discharge the liquid refrigerant. The dryer body 181 may have an approximately cylindrical shape. The inflow hole 181*a* may be also defined in the upper portion of the dryer body 181, and the discharge hole 181*b* may be defined in the lower portion of the dryer body 181.

At least one filter member 182 for removing impurities or moisture of the refrigerant introduced through the inflow hole 181*a* may be disposed within the dryer body 181. For example, the filter member 182 may be provided in plurality. The plurality of filter members 182 may fill at least one portion of the inner space of the dryer body 181. Each of the filter members 182 may have an approximately circular shape. The impurities or moisture of the refrigerant may be filtered while passing through the plurality of filter members 182. The filter member 182 may be formed of a material that easily adsorbs the impurities or moisture thereto.

A support or plate 183 supporting the plurality of filter members 182 is disposed within the dryer body 181. The plurality of filter members 182 may be disposed from the support part 183 to a position that is adjacent to the inflow hole 181*a*. The support 183 may partition the inner space of the dryer body 181 into an upper space and a lower space. The plurality of filter members 182 may be disposed in the upper space.

The support 183 may be spaced apart from an inner circumferential surface of the dryer body 181. A side surface of the support part 183 may be spaced apart from the inner circumferential surface of the dryer body 181.

In detail, the inner space of the dryer body 181 may include a first space 183*a* defined between an outer circumferential surface of the support 183 and the inner circumferential surface of the dryer body 181. The first space 183*a* may define a flow space through which the liquid refrigerant passing through the plurality of filter members 182 flows.

A second space 181*c* in which the liquid refrigerant is stored may be defined under the support 183. The second space 181*c* includes a floating member or float 185 spaced apart from a lower portion of the support 183 to move vertically, and a third space 185*a* defined between a side surface of the floating member 185 and the inner circumferential surface of the dryer body 181.

The floating member 185 may have an approximately cone shape that has a diameter gradually decreasing downward. The floating member 185 may also have a flow space in which the liquid refrigerant flows. The floating member 185 may have a lower portion that selectively opens or close the discharge hole 181*b*. For example, the lower portion of the floating member 185 may close the discharge hole 181*b* when the floating member 185 descends and open the discharge hole 181*b* when the floating member 185 ascends.

The third space 185*a* may be understood as a space defined between the floating member 185 and the dryer body 181. Thus, when the liquid refrigerant is fully filled into the third space 185*a*, the floating member 185 may move upward by the liquid refrigerant.

The guide member 190 has one side connected to an upper portion of the dryer body 181 and the other side connected to a lower portion of the dryer body 181. Here, the term "upper portion" may represent a portion of the dryer body 181 that is disposed above the support part 183, and the term "lower portion" may represent a portion of the dryer body 181 that is disposed under the support part 183.

The guide tube 190 includes a tube outlet 191 connected to the upper portion of the dryer body 181 to guide the gaseous refrigerant existing in the dryer body 181 to the outside of the dryer body 181 and a tube inlet 192 connected to the lower portion of the dryer body 181 to guide the refrigerant heat-exchanged with the second evaporator 160, i.e., the liquid refrigerant to the inside of the dryer body 181.

The tube outlet 191 may have an end that is disposed within the dryer body 181 to face the lower side (dotted lines). Also, the tube inlet 192 may have an end that is connected to the floating member 185 to guide the refrigerant into the floating member 185. The refrigerant introduced into the dryer body 181 through the tube inlet 192 may flow toward the discharge hole 181*b* through the floating member 185.

An effect of the dryer 180 will be described with reference to FIG. 5. After the refrigerant is condensed in the condenser 120 (see, e.g., FIG. 6), the two-phase refrigerant may be introduced into the dryer body 181 through the inflow part 181*a* of the dryer 180. The impurities or moisture contained in the refrigerant may be filtered while passing through the plurality of filter members 182, and the liquid refrigerant may flow toward a lower side of the support 183 through the first space 183*a*, i.e., into the second space 183*c*.

As an amount of liquid refrigerant flowing into the second space 183*c* increases, the liquid refrigerant in the third space 185*a* may be more cooled or collected. The floating member 185 may move upward by to buoyancy of the liquid refrigerant (A). As the floating member 185 moves, the lower portion of the floating member 185 may open the discharge hole 181*b*.

Thus, the liquid refrigerant of the second space 183*c* may flow downward and then be discharged to the outside of the dryer 180 through the discharge hole 181*b*. The gaseous refrigerant of the refrigerant introduced through the inflow hole 181*a* may be discharged to the outside of the dryer 180 through the tube outlet part 191. The refrigerant of the tube outlet 191 may flow toward one side of the second evaporator 160 via the guide tube 190.

The gaseous refrigerant may be indirectly heat-exchanged with the second evaporator 160 or may directly contact the second evaporator 160 and thus be directly heat-exchanged with the second evaporator 160. The gaseous refrigerant may be condensed by the low-temperature refrigerant to phase-change into a liquid refrigerant. The phase-changing refrigerant may flow into the tube inlet 192 via the guide tube 190, and then be introduced into the dryer 180 to flow into the inner space of the floating member 185. The refrigerant together with the liquid refrigerant existing in the dryer 180 may be discharged to the outside of the dryer 180 through the discharge hole 181*b*.

Figure 6:
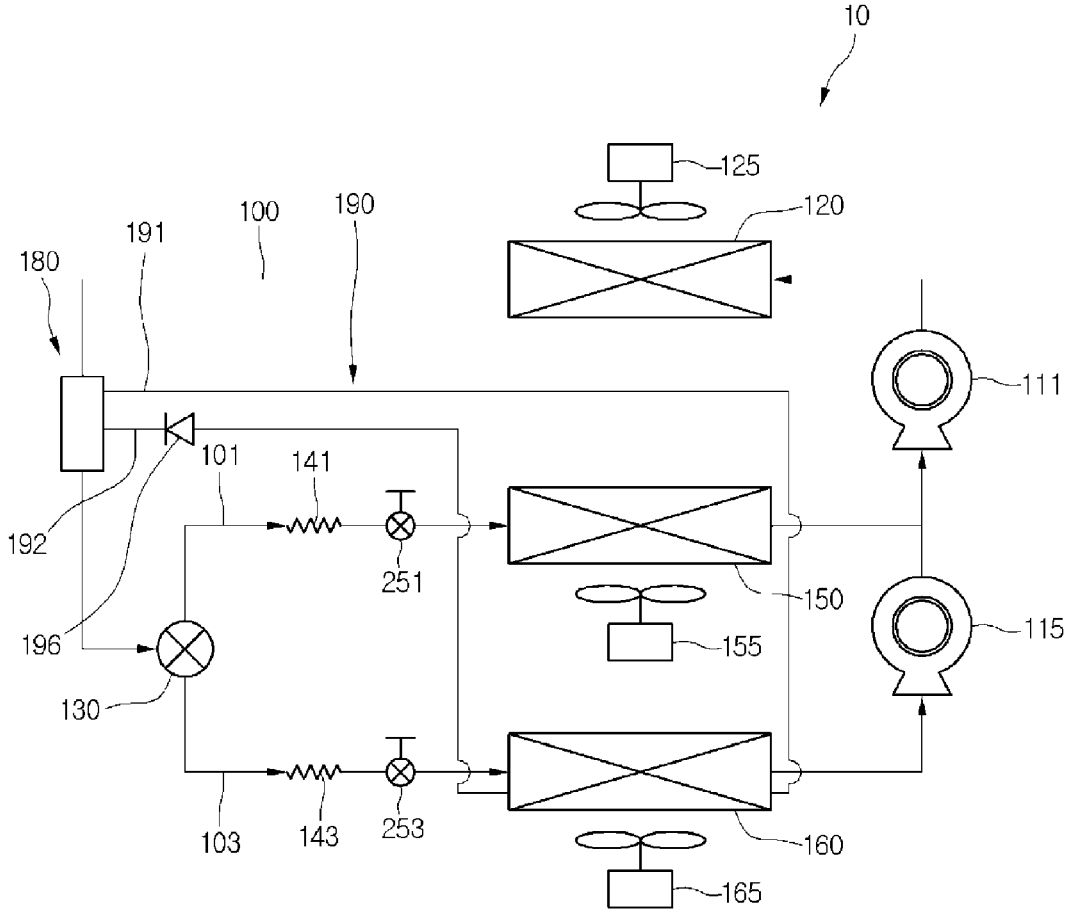
FIG. 6 is a view illustrating a refrigerant cycle in the refrigerator according to the first embodiment.

FIG. 6 is a view illustrating a refrigerant cycle in the refrigerator according to the first embodiment. The refrigerator 10 includes a plurality of compressors 111 and 115 for compressing a refrigerant, a condenser 120 for condensing the refrigerant compressed in the plurality of compressors 111 and 115, a plurality of expansion devices 141 and 143 for decompressing the refrigerant condensed in the condenser 120, and a plurality of evaporators 150 and 160 for evaporating the refrigerant decompressed in the plurality of expansion devices 141 and 143. The refrigerator 10 includes a refrigerant tube 100 connecting the plurality of compressors 111 and 115, the condenser 120, the expansion devices 141 and 143, and the evaporators 150 and 160 to each other to guide a flow of the refrigerant.

The plurality of compressors 111 and 115 include the compressor 111 and the second compressor 115. For example, when both or all of the plurality of compressors 111 and 115 are driven, the second compressor 115 may be a "low-pressure compressor" that is disposed a low-pressure side to compress the refrigerant in one stage, and the first compressor 111 may be a "high-pressure compressor" for further compressing (a two-stage compression) the refrigerant compressed in the second compressor 115. When all of the plurality of compressors 111 and 115 are driven, the simultaneous operation of the refrigerating compartment 20 and the freezing compartment 30 may be performed.

On the other hand, if only the first compressor 111 of the plurality of compressors 111 and 115 is driven, an exclusive cooling operation may be performed for the storage compartment in which the first evaporator 150 is disposed, i.e., the refrigerating compartment 20.

The plurality of evaporators 150 and 160 include a first evaporator 150 for generating cool air to be supplied into one of the refrigerating compartment 20 and the freezing compartment 30 and a second evaporator 160 for generating cool air to be supplied into the other of the refrigerating compartment 20 and the freezing compartment 30. For example, as described above, the first evaporator 150 may generate cool air to be supplied into the refrigerating compartment 20 and be disposed on a side of the refrigerating compartment 20. Also, the second evaporator 160 may generate cool air to be supplied into the freezing compartment 30 and be disposed on a side of the freezing compartment 30.

The cool air supplied into the freezing compartment 30 may have a temperature less than that of the cool air supplied into the refrigerating compartment 20. The refrigerant within the second evaporator 160 may have an evaporation pressure less than that of the refrigerant within the first evaporator 150. An outlet-side refrigerant tube 100 of the second evaporator 160 may extend to an inlet-side of the second compressor 115. Thus, the refrigerant passing through the second evaporator 160 may be introduced into the second compressor 115.

The refrigerator 10 further includes a dryer 180 disposed on an outlet-side of the condenser 120 to remove moisture or impurities contained in the refrigerant condensed in the condenser 120 and a guide tube 190 extending from the dryer 180 to one side of the second evaporator 160.

The guide tube 190 includes a tube outlet 191 guiding the gaseous refrigerant existing in the dryer 180 to the outside of the dryer 180 and a tube inlet 192 guide the refrigerant heat-exchanged with the evaporator 160 to the inside of the dryer 180. The refrigerant may flow from the tube outlet 191 to one side of the second evaporator 160 and from the tube inlet 192 to the dryer 180. The guide tube 190 further includes a check valve 196 for allowing the refrigerant in the guide tube 190 to forcibly flow in one direction. The flow of the refrigerant from the tube inlet 192 to the second evaporator 160 may be restricted by the check valve 196. For example, the check valve 196 may be disposed at or near the tube inlet 192.

The flow adjustment part or valve 130 may be disposed on an outlet-side of the dryer 180. The flow adjustment part 130 may be understood as one evaporator of the first and second evaporators 150 and 160 so that at least one evaporator of the first and second evaporators 150 and 160 is driven, or a device for adjusting a flow of the refrigerant so that the refrigerant is divided into the first and second evaporators 150 and 160 to flow. The flow adjustment part 130 includes a three-way valve having one inflow part or port through which the refrigerant is introduced and two discharge parts or ports through which the refrigerant is discharged. A plurality of refrigerant passages 101 and 103 are connected to the two discharge parts of the flow adjustment part 130.

The plurality of refrigerant passages 101 and 103 include a first refrigerant passage 101 disposed on an inlet-side of the first evaporator 150 to guide the introduction of the refrigerant into the first evaporator 150 and a second refrigerant passage 103 disposed on an inlet-side of the second evaporator 160 to guide the introduction of the refrigerant into the second evaporator 160. The first and second refrigerant passages 101 and 103 may be branched passages of the refrigerant tube 100 and thus be called "first and second evaporation passages", respectively. Also, the flow adjustment part 130 may be understood to be disposed on a branch part that is branched into the first and second refrigerant passages 101 and 103.

The refrigerant passing through the flow adjustment part 130 may be divided and discharged into the first and second refrigerant passages 101 and 103. The discharge parts connected to the first and second refrigerant passages 101 and 103 may be called a "first discharge part" and a "second discharge part", respectively. At least one of the first and second discharge parts may be opened. For example, when all or both of the first and second discharge parts are opened, the refrigerant may flow through the first and second refrigerant passages 101 and 103. On the other hand, when the first discharge part is opened, and the second discharge part is closed, the refrigerant may flow through the first refrigerant passage 101. Of course, when the first discharge part is closed, and the second discharge part is opened, the refrigerant may flow through only the second refrigerant passage 103.

The first expansion device 141 for expanding the refrigerant to be introduced into the first evaporator 150 may be disposed in the first refrigerant passage 101. The second expansion device 143 for expanding the refrigerant to be introduced into the second evaporator 160 may be disposed in the second refrigerant passage 103. Each of the first and second expansion devices 141 and 143 may include a capillary tube. The cool air passing through the second evaporator 160 may be cooled at a temperature less than that of the cool air passing through the first evaporator 150 and then be supplied into the freezing compartment 30.

The refrigerator 10 includes blower fans 125, 155, and 165 disposed on one side of the heat exchanger to blow air. The blower fans 125, 155, and 165 includes a condensation fan 125 provided on one side of the condenser 120, a first evaporation fan 155 provided on one side of the first evaporator 150, and a second evaporation fan 165 provided on one side of the second evaporator 160. As described above, the first evaporation fan 155 may be the refrigerating compartment fan, and the second evaporation fan 165 may be the freezing compartment fan.

Each of the first and second evaporators 150 and 160 may vary in heat-exchange performance according to a rotation rate of each of the first evaporation fans 155 and 165. For example, if a large amount of refrigerant is required according to the operation of the first or second evaporator 150 or 160, the first or second evaporation fan 155 or 166 may increase in rotation rate. If the cool air is sufficient, the first or second evaporation fan 155 or 165 may be reduced in rotation rate.

In the present embodiment, as illustrated in FIG. 3, the guide tube 190 may extend from the dryer 180 to the one side of the second evaporator 160 and thus be indirectly heat-exchanged with the refrigerant flowing into the second evaporator 160, i.e., be heat-exchanged with low-temperature air around the second evaporator 160.

In an alternative embodiment, the guide tube 190 may extend to one side of the first evaporator 150 and thus be directly heat-exchanged with the refrigerant flowing into the first evaporator 150, i.e., be heat-exchanged with low-temperature air around the first evaporator 150. Alternatively, the guide tube 190 may be branched into one side of each of the first and second evaporators 150 and 160 to extend. Alternatively, the guide tube 190 may be disposed to pass through a rear space of the inner case 13, i.e., a surrounding region of the refrigerating compartment cool air discharge part 22 or freezing compartment cool air discharge part. In this case, the refrigerant of the guide tube 190 may be cooled by cool air flowing into the refrigerating compartment cool air discharge part 22 or freezing compartment cool air discharge part.

The refrigerator 10 includes flow rate adjustment parts or valves 251 and 253 for adjusting a flow of the refrigerant. The flow rate adjustment parts 251 and 253 may be disposed in at least one refrigerant passage of the first and second refrigerant passages 101 and 103. For example, the flow rate adjustment parts 251 and 253 may include a first flow rate adjustment part 251 disposed in the first refrigerant passage 101 and a second flow rate adjustment part 253 disposed in the second refrigerant passage 103.

Each of the first and second flow rate adjustment parts 251 and 253 may include an electric expansion valve (EEV) of which an opening degree is adjustable. If the opening degree or an amount of flow by changing a size of a port opening of the first or second flow rate adjustment part 251 or 253 decreases, an amount of refrigerant flowing through an opening having the decreasing opening degree may decrease. On the other hand, if the opening degree of the first or second flow rate adjustment part 251 or 253 increases, an amount of refrigerant flowing through an opening having the increasing opening degree may increase.

For example, if the opening degree of the first flow rate adjustment part 251 is relatively greater than that of the second flow rate adjustment part 253, a larger amount of refrigerant may flow into the first refrigerant passage 101, and thus an amount of refrigerant introduced into the first evaporator 150 may increase. On the other hand, if the opening degree of the first flow rate adjustment part 251 is relatively less than that of the second flow rate adjustment part 253, a larger amount of refrigerant may flow into the second refrigerant passage 103, and thus an amount of refrigerant introduced into the second evaporator 160 may increase.

Since the first and second flow rate adjustment parts 251 and 253 are provided, the opening degree of each of the refrigerant passages may be finely adjustable. An amount of refrigerant to be introduced into the first or second evaporator 150 or 160 may be finely adjustable. As a result, while the first and second evaporators 150 and 160 operate, a refrigerant concentration into the first or second evaporator 150 or 160 may be prevented. In an alternative embodiment, the capillary of expansion device and flow adjustment part may be replaced with a thermal expansion valve.

Although the first and second flow rate adjustment parts 251 and 253 are respectively disposed in the first and second refrigerant passages 101 and 103 in FIG. 1, the present disclosure is not limited thereto. In an alternative embodiment, one flow rate adjustment part may be disposed in the first or second refrigerant passage 101 or 103. Since the flow rate adjustment part is provided in one refrigerant passage to adjust the opening degree, an amount of refrigerant passing through the other refrigerant passage may be relatively adjustable. That is, if the opening degree of the flow rate adjustment part increases, an amount of refrigerant passing through the other refrigerant passage may decrease. On the other hand, if the opening degree of the flow rate adjustment part decreases, an amount of refrigerant passing through the other refrigerant passage may increase.

Figure 7:
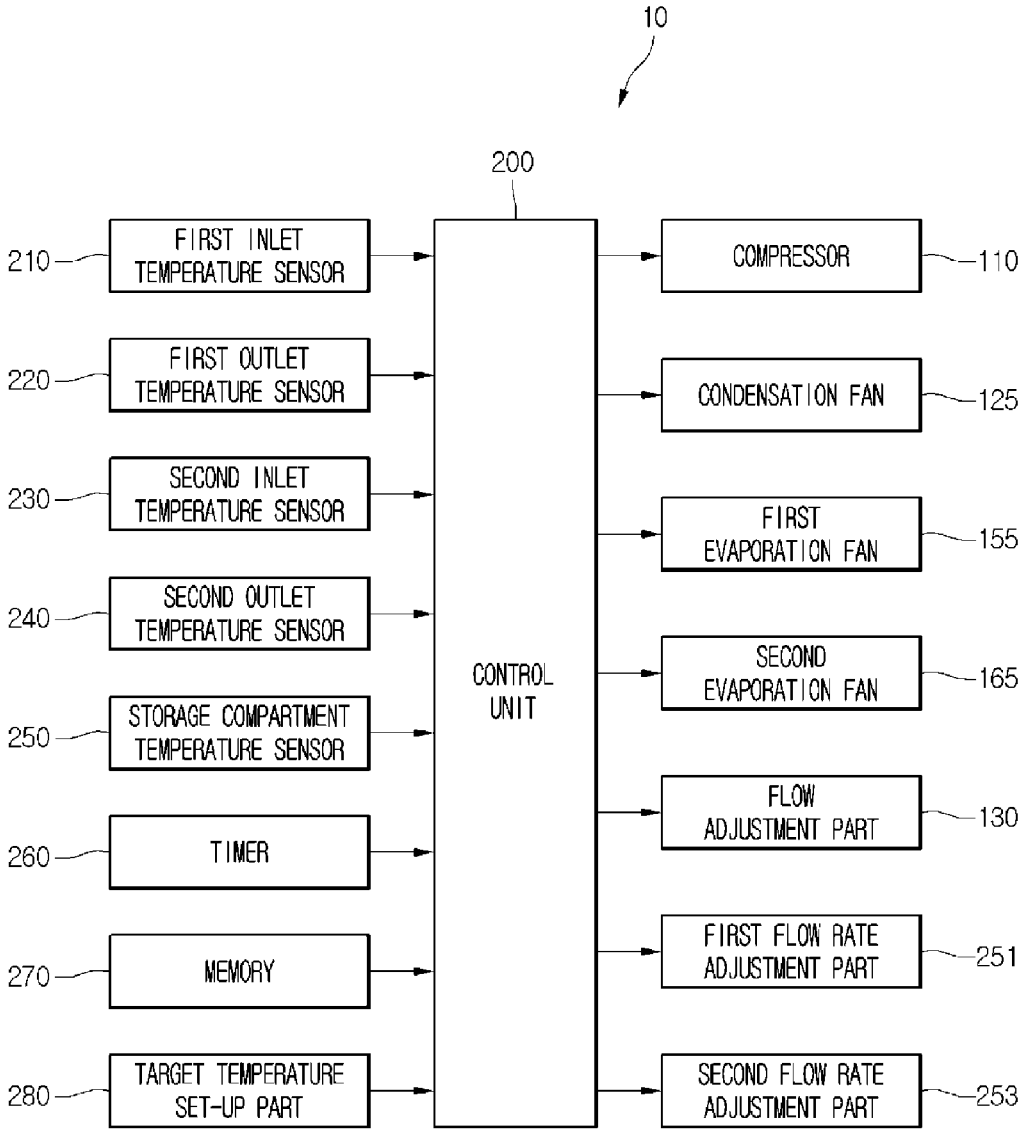
FIG. 7 is a block diagram illustrating constitutions of the refrigerator according to the first embodiment.
Figure 8:
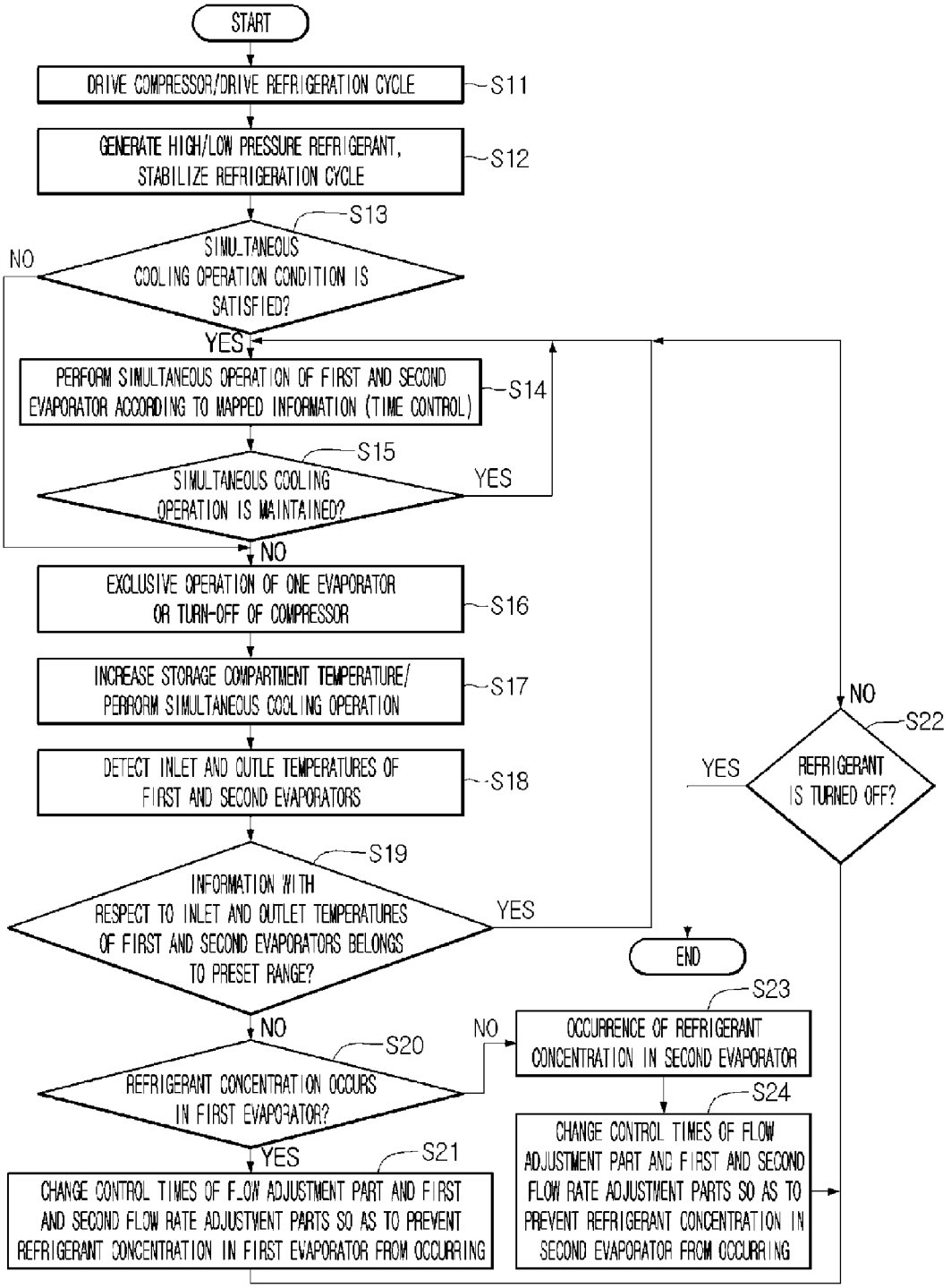
FIG. 8 is a flowchart illustrating a method for controlling the refrigerator according to the first embodiment.

FIG. 7 is a block diagram illustrating constitutions of the refrigerator according to the first embodiment, and FIG. 8 is a flowchart illustrating a method for controlling the refrigerator according to the first embodiment. A refrigerator 1 according to the first embodiment includes a plurality of temperature sensors 210, 220, 230, and 240 for detecting inlet or outlet temperatures of each of the first and second evaporators 150 and 160.

The plurality of temperature sensors 210, 220, 230, and 240 include a first inlet temperature sensor 210 for detecting an inlet-side temperature of the first evaporator 150 and a first outlet temperature sensor 220 for detecting an outlet-side temperature of the first evaporator 150. The plurality of temperature sensors 210, 220, 230, and 240 include a second inlet temperature sensor 230 for detecting an inlet-side temperature of the second evaporator 160 and a second outlet temperature sensor 240 for detecting an outlet-side temperature of the second evaporator 160.

The refrigerator 10 may further include a control unit or controller 200 for controlling an operation of the flow adjustment part 130 on the basis of the temperatures detected by the plurality of temperature sensors 210, 220, 230, and 240. To perform simultaneous cooing operations of the refrigerating and freezing compartments, the control unit 200 may control operations of the compressor 110, the condensation fan 125, and the first and second evaporation fans 155 and 165. The compressor 110 includes a first compressor 111 and a second compressor 115.

The refrigerator 10 includes a storage compartment temperature sensor 250 detecting an inner temperature of the refrigerator storage compartment. The storage compartment temperature sensor 250 includes a refrigerating compartment temperature sensor disposed in the refrigerating compartment to detect an inner temperature of the refrigerating compartment and a freezing compartment temperature sensor disposed in the freezing compartment to detect an inner temperature of the freezing compartment.

The refrigerator 10 also includes a target temperature set-up part or module/interface 280 for inputting a target temperature of the refrigerating compartment or the freezing compartment. For example, the target temperature set-up part 280 may be disposed on a position which is easily manipulated by a user on a front surface of the refrigerating compartment door or the freezing compartment door.

The information inputted through the target temperature set-up part 280 may become control reference information of the compressor 110, the plurality of blower fans 125, 155, and 165, and the flow adjustment part 130. The control unit 200 may determine the simultaneous cooling operation of the refrigerating compartment and the freezing compartment, an exclusive operation of one storage compartment, or turn-off of the compressor 110 on the basis of the information inputted by the target temperature set-up part 280 and the information detected by the storage compartment temperature sensor 250.

For example, if the inner temperatures of the refrigerating compartment and the freezing compartment are higher than that inputted by the target temperature set-up part 280, the control unit 200 may control the compressor 110 and the flow adjustment part 130 to perform the simultaneous cooling operation.

On the other hand, if the inner temperature of the freezing compartment is higher than that inputted by the target temperature set-up part 280, and the inner temperature of the refrigerating compartment is lower than that inputted by the target temperature set-up part 280, the control unit 200 may control the compressor 110 and the flow adjustment part 130 to perform a cooling operation for only the freezing compartment.

When the inner temperatures of the refrigerating compartment and the freezing compartment are lower than that inputted by the target temperature set-up part 280, the control unit 200 may turn the compressor 110 off.

The refrigerator may further include a timer 260 for integrating a time elapsing value for the operation of the flow adjustment part 130 while the simultaneous cooling operation of the refrigerating compartment and the freezing compartment is performed. For example, the timer 260 may integrate a time that elapses in a state where all or both of the first and second refrigerant passages 101 and 103 are opened or a time that elapses in a state where one of the first and second refrigerant passages 101 and 103 is opened.

The refrigerator 10 may further include a memory or memory unit 250 for mapping time values with respect to the adjusted states of the flow adjustment part 130 and the first and second flow rate adjustment parts 251 and 253 to previously store the mapped values while the simultaneous cooling operation of the refrigerating compartment and the freezing compartment is performed. In the current embodiment, information mapped as shown in Table 1 below may be stored in the memory unit 250.

TABLE 1

| Refrigerant concentration | Case 1 | Case 2 |
|---|---|---|
| Simultaneous cooling operation start (reference value) | 90 seconds | 90 seconds |
| When refrigerant concentration occurs in first evaporator | 90 seconds | 120 seconds |

TABLE 1-continued

| Refrigerant concentration | Case 1 | Case 2 |
|---|---|---|
| When refrigerant concentration occurs in second evaporator | 90 seconds | 60 seconds |

Referring to Table 1 above, the "case 1" may be understood as a first control state (an adjusted state) of the flow adjustment part 130 and the first and second flow adjustment parts 251 and 252, i.e., a state in which an amount of refrigerant flowing into the first refrigerant passage 101 is greater than that of refrigerant flowing into the second refrigerant passage 103. In detail, the case 1 may be a state in which the flow adjustment part 130 is adjusted to open all of the first and second refrigerant passages 101 and 103, and an adjustment of an opening degree of the first flow rate adjustment part 251 is greater than that of the second flow rate adjustment part 253.

The case 1 may include a state in which the first flow rate adjustment part 251 is opened, and the second flow rate adjustment part 253 is closed. This state also includes the instance where the opening degree of the first flow rate adjustment part 251 is greater than that of the second flow rate adjustment part 253 in the state even though the first and second flow rate adjustment parts 251 and 253 are opened.

On the other hand, the "case 2" may be understood as a second control state (an adjusted state) of the flow adjustment part 130 and the first and second flow adjustment parts 251 and 252, i.e., a state in which an amount of refrigerant flowing into the second refrigerant passage 103 is greater than that of refrigerant flowing into the first refrigerant passage 101. The case 2 may be a state in which the flow adjustment part 130 is adjusted to open both of the first and second refrigerant passages 101 and 103, and an adjustment of an opening degree of the second flow rate adjustment part 253 is greater than that of the first flow rate adjustment part 251.

The case 2 may include a state in which the second flow rate adjustment part 253 is opened, and the first flow rate adjustment part 251 is closed. This state may also include the instance where the opening degree of the second flow rate adjustment part 253 is greater than that of the first flow rate adjustment part 251 when both of the first and second flow rate adjustment parts 251 and 253 are opened.

For example, if the simultaneous cooling operation conditions are satisfied, i.e., it may be determined that the cooling operation is required for all of the refrigerating compartment and the freezing compartment. If such condition is met, the simultaneous cooling operation may start. The control unit 200 may maintain the first control state for about 90 seconds, and then maintain the second control state for about 90 seconds. The first and second control states may be alternately performed if it is unnecessary to perform the simultaneous cooling operation.

While the first and second control states are repeatedly or alternately performed, when the inner temperature of the refrigerating compartment or the freezing compartment reaches a target temperature, the supply of the refrigerant into at least one evaporator may be stopped (exclusive one evaporator operation). Also, when all of the inner temperatures of the refrigerating compartment and the freezing compartment reach the target temperature, the compressor 110 may be turned off.

When the exclusive one evaporator operation or the turn-off of the compressor 110 are maintained for a predetermined time, and it is need to perform the simultaneous cooling operation of the refrigerating compartment and the freezing compartment, the control unit 200 may determine a refrigerant concentration in the first or second evaporator 150 or 160 on the basis of the temperature values detected by the temperature sensors 210, 220, 230, and 240.

If it is determined that the refrigerant concentration in the first evaporator 150 occurs, the control unit 200 may change the time values according to the first and second cases 1 and 2 to apply the changing time values. In other words, when there is an occurrence of refrigerant concentration in the first evaporator, since a time for supplying the refrigerant into the second evaporator 160 has to relatively increase, a control time with respect to the case 2 may increase (about 120 seconds).

On the other hand, when there is an occurrence of refrigerant concentration in the second evaporator, since a time taken to supply the refrigerant into the first evaporator 150 has to relatively increase, a control time with respect to the case 2 may decrease (about 60 seconds).

Generally, if it is determined that the refrigerant concentration in one evaporator occurs, the control time with respect to the case 2 may be adjusted to prevent the refrigerant concentration in the evaporator from occurring. Here, it may be determined that a cooling load of the storage compartment, in which the second evaporator 160 is disposed, is less than that of the storage compartment, in which the first evaporator 150 is disposed.

As a result, the control time with respect to the case 1 for increasing the supply of the refrigerant into the storage compartment having a relatively large cooling load may be fixed, and the control time with respect to the case 2 for increasing the supply of the refrigerant into the storage compartment having a relatively small cooling load may be changed. Thus, the storage compartment having a large cooling load may be stably maintained for cooling efficiency.

The control time of the flow adjustment part 130 and the first and second flow rate adjustment parts 251 and 253 according to the case 1 is called a "first set-up time", and the control time of the flow adjustment part 130 and the first and second flow rate adjustment parts 251 and 253 is called a "second set-up time".

In Table 1 above, the information with respect to the time value for successively performing the cases 1 and 2 while a simultaneous cooling operation is performed and the changing time for successively performing the cases 1 and 2 when the refrigerant concentration in the one evaporator occurs may be obtained through repeated fine tuning.

A method for controlling the refrigerator according to the first embodiment will be described with reference to FIG. 8. To drive the refrigerator, the first and second compressor 111 and 115 are driven. A refrigeration cycle according to the compression-condensation-expansion-evaporation of the refrigerant may operate according to the driving of the compressor 110. The refrigerant evaporated in the second evaporator 160 may be compressed in the second compressor 115, and the compressed refrigerant may be mixed with the refrigerator evaporated in the first evaporator 150, and then, the mixture may be introduced into the first compressor 111 (S11).

The simultaneous cooling operation of the refrigerating compartment and the freezing compartment may be initially performed according to the operation of the refrigeration cycle. When a predetermined time elapses, a pressure value according to the refrigerant circulation may reach a preset range. For example, a high pressure of the refrigerant discharged from the first and second compressors 111 and 115 and a low pressure of the refrigerant discharged from the first and second evaporators 150 and 160 may be set within the present range.

When the high and low pressures of the refrigerant are set within the preset range, the refrigeration cycle may be stabilized to continuously operate. In this instance, a target temperature of the storage compartment of the refrigerator may be previously set (S12).

While the refrigeration cycle operates, it is determined whether the simultaneous cooling operation conditions of the refrigerating compartment and the freezing compartment are satisfied. For example, if it is determined that the inner temperature of the refrigerating compartment and the freezing compartment is above the target temperature through the value detected by the storage compartment temperature sensor 250, the simultaneous cooling operation of the refrigerating compartment and the freezing compartment may be performed (S13).

When the simultaneous cooling operation is performed, the simultaneous operation of the first and second evaporators 150 and 160 may be performed according to the previously mapped information. In other words, the flow adjustment part 130 may be controlled in operation to simultaneously supply the refrigerant into the first and second evaporators 150 and 160.

As shown in Table 1 above, in the flow adjustment part 130 and the first and second flow rate adjustment parts 251 and 253, the first adjustment state according to the case 1 may be maintained for about 90 seconds, and the second adjustment state according to the case 2 may be maintained for about 90 seconds. A time control operation for preventing the refrigerant concentration into the second evaporator 160 from occurring is performed firstly according to the case 1, and then a time control operation for preventing the refrigerant concentration into the first evaporator 150 from occurring is performed according to the case 2 (S14).

When the simultaneous cooling operation according to the cases 1 and 2 is performed at least one time, it is determined whether the simultaneous cooling operation of the refrigerating compartment and the freezing compartment has to be maintained. For example, whether the temperature of the refrigerating compartment or the freezing compartment reaches the target temperature may be detected through the storage compartment temperature sensor 250.

If the temperature of the refrigerating compartment or the freezing compartment reaches the target temperature, it may be unnecessary to perform the cooling of the corresponding storage compartment, and thus it may be unnecessary to perform the simultaneous cooling operation.

When the exclusive cooling operation of the storage compartment, which does not reach the target temperature, i.e., the cooling operation of the evaporator of only the refrigeration or only the freezing storage compartment is performed, or all of the storage compartments reach the target temperature, the compressor 110 may be turned off.

On the other hand, when both temperatures of the refrigerating compartment and the freezing compartment do not reach the target temperature, the process may return to the operation S14 to perform the simultaneous operation of the first and second evaporators 150 and 160 again. The simultaneous operation may be repeatedly performed until at least one of the refrigerating compartment and the freezing compartment reaches the target temperature.

As described above, while the simultaneous operation of the first and second evaporators 150 and 160 is performed, the controls of the flow adjustment part 130 and the first and second flow rate adjustment parts 251 and 253 according to the cases 1 and 2 may be successively or alternately performed to prevent the refrigerant concentration from occurring in the first and second evaporators 150 and 160. Such an operation improves the cooling efficiency of the storage compartment and the operation efficiency of the refrigerator (S15 and S16).

In the operation S16, when time elapses during the exclusive operation of one evaporator, or turn off of the compressor 110, the refrigerating compartment and the freezing compartment may increase in temperature. When the temperature of the refrigerating compartment or the freezing compartment increase to a temperature out of the target temperature range, it may be necessary to cool the storage compartment that increases in temperature or to operate the compressor 110 that is in the turn-off state. The simultaneous cooling operation of the refrigerating compartment and the freezing compartment may be performed again (S17).

While the simultaneous cooling operation is performed again, a change in the control times of the flow adjustment part 130 and the first and second flow rate adjustment parts 251 and 253 according to the cases 1 and 2 may be determined. For example, the inlet and outlet temperatures of the first evaporator 150 may be detected by the first inlet and outlet temperature sensors 210 and 220. Further, the inlet and outlet temperatures of the second evaporator 160 may be detected by the second inlet and outlet temperature sensors 230 and 240 (S18).

The control unit 200 may determine an inlet/outlet temperature difference value of the first evaporator 150 and an inlet/outlet temperature difference value of the second evaporator 160. When an amount of refrigerant introduced into the first or second evaporator 150 or 160 is above an adequate refrigerant amount, the difference in value between the inlet and outlet temperatures of the first or second evaporator 150 and 160 may decrease. On the other hand, when an amount of refrigerant introduced into the first or second evaporator 150 or 160 is below the adequate refrigerant amount, the difference in value between the inlet and outlet temperatures of the first or second evaporator 150 or 160 may increase.

The control unit 200 may determine whether information with respect to the difference in value between the inlet and outlet temperatures of the first or second evaporator 150 or 160 belongs to a preset range. For example, the control unit 200 may determine whether an amount of refrigerant flowing into the first or second evaporator 150 or 160 is excessive or lacking, i.e., whether the refrigerant is concentrated into the first evaporator 150 or second evaporator 160, on the basis of the inlet/outlet temperature difference of the first evaporator 150 and the inlet/outlet temperature difference of the second evaporator 160.

Whether the amount of refrigerant flowing into the first or second evaporator 150 or 160 is excessive or lacking may be determined on the basis of the inlet/outlet temperature difference of the first evaporator 150, the inlet/outlet temperature difference of the second evaporator 160, or a ratio of the inlet/outlet temperature differences of the first and second evaporators 150 and 160 (S19).

As an example of the determination method, it may be determined whether the refrigerant is concentrated according to whether the inlet/outlet temperature difference of the first evaporator 150 is equal to or greater or less than a preset reference valve.

The refrigerant circulated into the refrigeration cycle may be divided into the first and second evaporators 150 and 160 through the flow adjusting part 130 to flow. When the inlet/outlet temperature difference of the first evaporator 150 is detected, a rate of the refrigerant passing through the first evaporator 150 may be determined. A rate of the refrigerant passing through the second evaporator 160 may be determined on the basis of the rate of the refrigerant passing through the first evaporator 150.

For example, when the inlet/outlet temperature difference of the first evaporator 150 is greater than the reference value, it may be determined that an amount of refrigerant is lacking. On the other hand, it may be recognized that an amount of refrigerant flowing into the second evaporator 160 is relatively larger than an amount of refrigerant flowing into the first evaporator 150.

In the current embodiment, a method for determining a refrigerant concentration phenomenon by using the inlet/outlet temperature difference of the first evaporator 150 will be described. The refrigerant concentration phenomenon may be determined by using the inlet/outlet temperature difference of the second evaporator 160.

If the inlet/outlet temperature difference of the first evaporator 150 is equal to the preset reference value (a reference temperature), it may be determined that the refrigerant concentration into the first or second evaporator 150 or 160 may not occur. In this case, the process may return to the operation S14, and then the operations of the flow adjustment part 130 and the first and second flow rate adjustment parts 251 and 253 may be controlled on the basis of the time value that is set when the simultaneous cooling operation starts. In other words, each of the adjusted states according to the cases 1 and 2 may be maintained for about 90 seconds. Thereafter, the operations S15 to S18 may be performed again.

On the other hand, if the inlet/outlet temperature difference of the first evaporator 150 is not equal to the preset reference value or is greater or less than the reference value, it may be determined that the refrigerant concentration into the first or second evaporator 150 or 160 occurs. For example, if the inlet/outlet temperature difference of the first evaporator 150 is less than the preset reference value, it may be determined that a relatively large amount of refrigerant passes through the first evaporator 150. That is, it may be determined that the refrigerant concentration into the first evaporator 150 occurs.

This case may correspond to the "the occurrence of the refrigerant concentration in the first evaporator" shown in Table 1, and thus, the control state according to the case 1 may be maintained for about 90 seconds, and the control state according to the case 2 may increase to about 120 seconds. In other words, since the adjusting time according to the case 2 increases in preparation for the "simultaneous cooling operation start", an amount of refrigerant introduced into the first evaporator 150 may relatively decrease (S20 and S21).

On the other hand, if the inlet/outlet temperature difference of the first evaporator 150 is greater than the preset reference value, it may be determined that a relatively small amount of refrigerant passes through the first evaporator 150. In other words, it may be determined that the refrigerant concentration into the second evaporator 160 occurs.

This case may correspond to the "the occurrence of the refrigerant concentration in the first evaporator" shown in Table 1, and thus, the control state according to the case 2 may be maintained for about 90 seconds, and the control state according to the case 2 may decrease to about 60 seconds. That is, since the adjusting time of the flow adjustment part 130 and the first and second flow rate adjustment parts 251 and 253 according to the case 2 decreases in preparation for the "simultaneous cooling operation start", an amount of refrigerant introduced into the first evaporator 150 may relatively increase (S23 and S24).

When the control times of the flow adjustment part 130 and the first and second flow rate adjustment parts 251 and 253 change by the above-described method, the processes after the operation S14 may be performed again on the basis of the changed control time value unless the refrigerator is turned off (S22).

As described above, since the control times of the flow adjustment part 130 and the first and second flow rate adjustment parts 251 and 253 change on the basis of the information with respect to the inlet and outlet temperature difference of the first and second evaporators 150 and 160, the refrigerant concentration in the first and second evaporators 150 and 160 may be prevented. Accordingly, the cooling efficiency may be improved, and the power consumption may be reduced.

Hereinafter, a description will be made according to a second embodiment. Since the current embodiment is the same as the first embodiment except for portions of the constitutions, descriptions of the same parts will be denoted by the same reference numerals and descriptions of the first embodiment.

Figure 9:
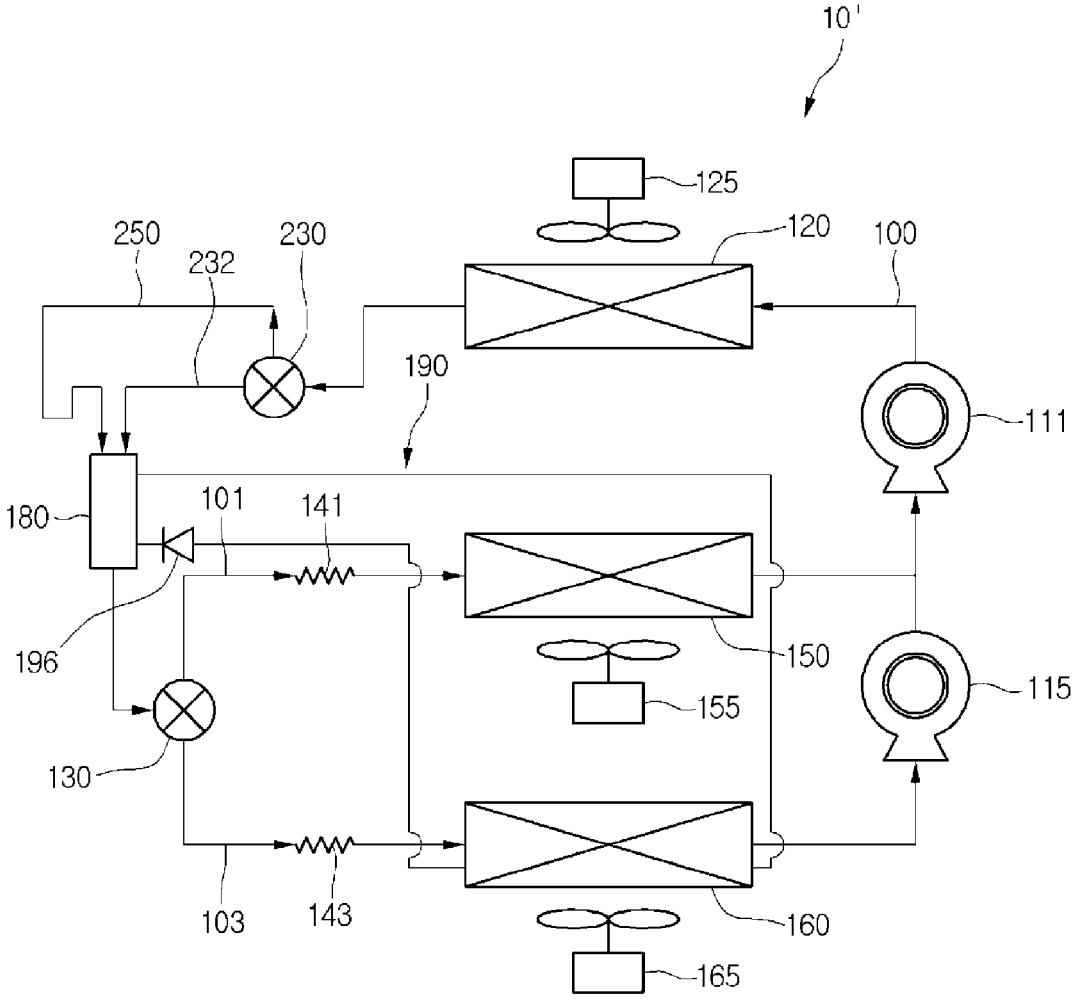
FIG. 9 is a view illustrating a refrigerant cycle in the refrigerator according to the second embodiment.
Figure 10:
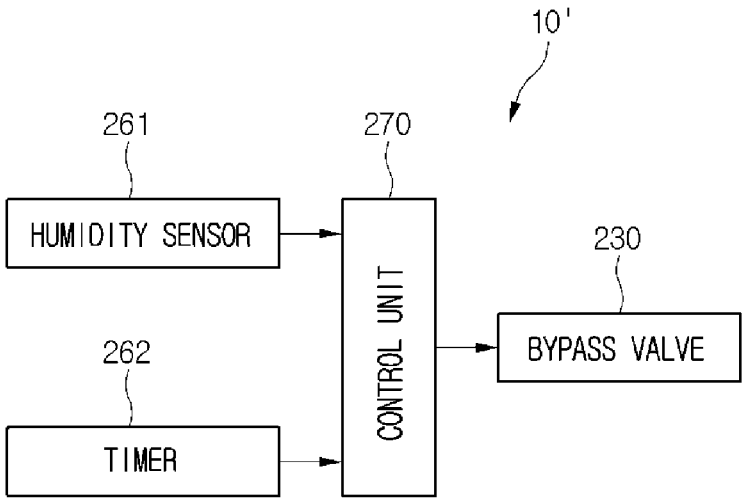
FIG. 10 is a block diagram illustrating constitutions of the refrigerator according to the second embodiment.
Figure 11:
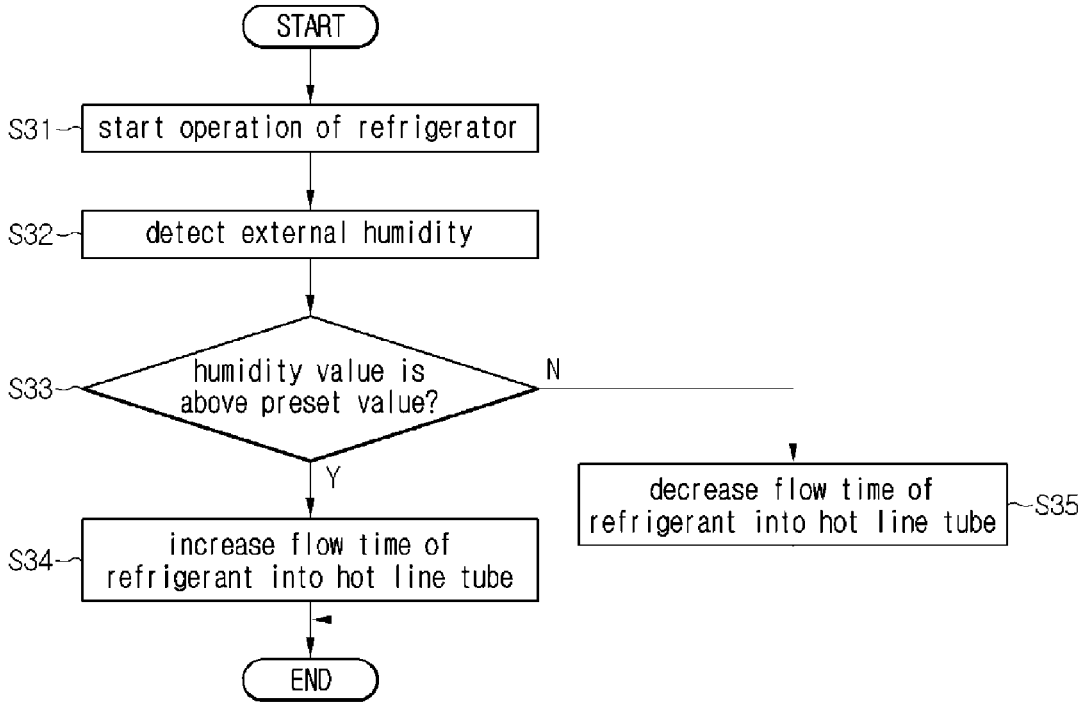
FIG. 11 is a flowchart illustrating a method for controlling the refrigerator according to the second embodiment.

FIG. 9 is a view illustrating a refrigerant cycle in the refrigerator according to the second embodiment, FIG. 10 is a block diagram illustrating constitutions of the refrigerator according to the second embodiment, and FIG. 11 is a flowchart illustrating a method for controlling the refrigerator according to the second embodiment. A refrigerator 10' according to a second embodiment includes the plurality of compressors 111 and 115, the condenser 120, the flow adjustment part 130, the plurality of evaporators 150 and 160, the plurality of expansion devices 141 and 143, and the blower fans 125, 155, and 165, which are previously described in the first embodiment.

The refrigerator 10' further include a hot line tube 250 disposed on an outlet-side of the condenser 120 to guide a high-pressure condensed refrigerant passing through the condenser 120 to a front side of a main body 11. The hot line tube 250 may be disposed inside an inner case 13 at a position at which the main body 11 and refrigerating compartment door 25 contact each other.

The high-temperature high-pressure refrigerant may flow into the hot line tube 250 to emit heat. The emitted heat may be transferred to a front side of the main body 11 to prevent dew generated due a temperature difference between the inside and the outside of the refrigerator from being formed on a front surface of the main body 11.

A bypass valve 230 for adjusting an amount of refrigerant introduced into the hot line tube 250 or an introduction time of the refrigerant may be disposed on an inlet-side of the hot line tube 250. The bypass valve 230 may be disposed between an outlet of the condenser 120 and an inlet of the dryer 180. Also, the hot line tube 250 may extend from the bypass valve 230 to the dryer 180.

The refrigerator 10' further include a bypass tube 232 extending from the bypass valve 230 to the dryer 180 to allow the refrigerant to bypass the hot line tube 250.

The bypass valve 230 includes a three-way valve for guiding the refrigerant into at least one tube of the hot line tube 250 and the bypass tube 232. In detail, the bypass valve 230 may be a valve for switching a flow direction of the refrigerant in one or the other direction or a valve for distributing the refrigerant in one or the other direction.

The bypass valve 230 may operate to allow the refrigerant to flow into the hot line tube 250 or the bypass tube 232. For example, when the bypass valve 230 is turned on, a passage for the refrigerant flowing into the bypass tube 232 may be blocked, and thus the entire refrigerant may flow into the hot line tube 250. When the bypass valve 230 is turned off, a passage for the refrigerant flowing into the hot line tube 250 may be blocked, and thus, the entire refrigerant may flow into the bypass tube 232.

Here, the term "turn-on" may represents "one-directional control" of the bypass valve 230, and the term "turn-off" may represents "the other-directional control" of the bypass valve 230.

As another example, the bypass valve 230 may operate to allow a portion of the refrigerant to flow into the hot line tube 250 and allow remaining refrigerant to flow into the bypass tube 232. The refrigerant condensed in the condenser 120 may be introduced into the bypass valve 230. Also, the refrigerant may flow into at least one tube of the hot line tube 250 and the bypass tube 232 according to the operation state of the bypass valve 230.

For example, if possibility of the dew formation on the refrigerator is great according to a predetermined condition, the bypass valve may operate so that an amount of refrigerant flowing into the hot line tube 250 increases, or a flow time of the refrigerant flowing into the hot line tube 250 increases. On the other hand, if possibility of the dew formation on the refrigerator is less, the bypass valve 230 may operate so that an amount of refrigerant flowing into the hot line tube 250 decreases, or a flow time of the refrigerant flowing into the hot line tube 250 decreases.

The dryer 180 may be disposed on an outlet-side of the hot line tube 250 or the bypass tube 232. The refrigerant flowing into the hot line tube 250 or the bypass tube 232 may be introduced into the dryer 180. The dryer 180 may remove impurities or moisture of the refrigerant or temporally store a liquid refrigerant. Further, the refrigerator 10' includes the guide tube 190 and a check valve 196 disposed in the guide tube 196, which are previously described in the first embodiment.

The refrigerant passing through the dryer 180 may be introduced into a flow adjustment part 130 and then be introduced into a first or second evaporator 150 or 160 through a first or second expansion device 141 or 143.

Referring to FIG. 10, the refrigerator 10' according to the second embodiment includes a humidity sensor 261 detecting an external humidity valve of the refrigerator 10', a timer 262 for integrating an operation time of the bypass valve 230, and a control unit 270 for controlling an operation of the bypass valve 230 on the basis of the humidity valve detected by the humidity sensor 261.

A method for controlling the refrigerator according to the second embodiment will be described with reference to FIG. 10. When an operation of the refrigerator 10' starts, the humidity sensor 261 detects external humidity of the refrigerator 10' (S31 and S32).

If the detected humidity value is above the preset valve, it may be determined that possibility of dew formation on the front surface of the refrigerator body increases. The bypass valve 230 may operate to allow a relatively large amount of refrigerant to flow toward the hot line tube 250. On the other hand, the bypass valve 230 may operate so that a time taken to allow the refrigerant to flow into the hot line tube 250 increases.

For example, when the bypass valve 230 is a valve for switching a flow direction of the refrigerant in one or the other direction, the bypass valve 230 may be turned on to guide the entire refrigerant passing through the condenser 120 to the hot line tube 250. Here, a time for which the bypass valve 230 is turned on may be determined to a valve that is above a preset time, i.e., a time value greater than the turn-on time value.

As another example, when the bypass valve 230 is a valve for distributing the refrigerant in one or the other direction, the bypass valve 230 may be controlled so that an opening degree of the refrigerant passage defined toward the hot line tube 250 is greater than that of the refrigerant passage defined toward the bypass tube 232 (S33 and S34).

On the other hand, if the detected humidity value is less than the preset value, it may be determined that the possibility of the dew formation on the front surface of the refrigerator body decreases. The bypass valve 230 may operate to allow a relatively small amount of refrigerant to flow toward the hot line tube 250. On the other hand, the bypass valve 230 may operate so that a time taken to allow the refrigerant to flow into the hot line tube 250 decreases.

For example, when the bypass valve 230 is a valve for switching a flow direction of the refrigerant in one or the other direction, the bypass valve 230 may be turned off to guide the entire refrigerant passing through the condenser 120 to the bypass tube 232. A time for which the bypass valve 230 is turned off may be determined to a valve that is above a preset time, i.e., a time value greater than the turn-off time value.

As another example, when the bypass valve 230 is a valve for distributing the refrigerant in one or the other direction, the bypass valve 230 may be controlled so that an opening degree of the refrigerant passage defined toward the bypass tube 232 is greater than that of the refrigerant passage defined toward the hot line tube 250 (S35).

According to the above-described control method, the operation of the bypass valve may be controlled according to the external humidity condition of the refrigerator to adjust an amount of refrigerant flowing into the hot line tube or a refrigerant flow time, thereby prevent the dew formation on the refrigerator from occurring and preventing a load applied into the refrigerator from increasing due to the excessive amount of refrigerant flowing into the hot line tube.

According to the embodiments, the dryer may be disposed at the outlet-side of the condenser, and the gaseous refrigerant of the two-phase refrigerant introduced into the dryer may be heat-exchanged with the evaporator and thus be condensed to improve the condensation efficiency and reduce the dryness fraction of the refrigerant introduced into the evaporator.

Since the dryness fraction of the refrigerant introduced into the evaporator is reduced, the heat-exchange efficiency may be improved, and thus, the power consumption may be improved.

Since the tube outlet is coupled to the upper portion of the dryer, the gaseous refrigerant of the two-phase refrigerant introduced into the dryer may easily flow into the evaporator.

Since the floating member floating by the liquid refrigerant is disposed within the dryer, and the floating member opens the outlet of the dryer when the liquid refrigerant is introduced with an amount greater than the preset amount, the dryer may be improved in operation reliability.

Since an amount of refrigerant supplied into the plurality of evaporators is adjustable on the basis of the previously determined time value and the inlet and outlet temperature difference of the plurality of evaporators while the refrigerant operates, the distribution of the refrigerant into the plurality of evaporators may be effectively realized.

As a result, the first control process for increasing an amount of refrigerant supplied into one evaporator of the plurality of evaporators and the second control process for increasing an amount of refrigerant supplied into the other evaporator of the plurality of evaporators may be basically performed according to the time period that is set during the simultaneous cooling operation.

Since the inlet and outlet temperature information of the first and second evaporators are confirmed to change the control time values in the first and second control processes, the refrigerant concentration into a specific evaporator of the plurality of evaporators may be prevented to realize the precision control.

Since the flow rate adjusting part of which an opening degree is adjustable is provided in the plurality of refrigerant passages, the flow rate of the refrigerant may be accurately controlled.

Since the bypass valve is disposed on the inlet-side of the hot line for prevent dew from being formed on the refrigerator to adjust an amount of refrigerant introduced into the hot line according to external humidity of the refrigerator, the dew formation on the refrigerator may be prevented, and the heat load transmitted into the refrigerator may be reduced by the hot line.

Embodiments provide a refrigerator that is improved in operation efficiency.

In one embodiment, a refrigerator includes: a compressor compressing a refrigerant; a condenser condensing the refrigerant compressed in the compressor; a dryer in which the refrigerant condensed in the condenser is introduced, the dryer removing impurities or moisture of the refrigerant; a flow adjustment part disposed on an outlet-side of the dryer to switch or control a flow direction of the refrigerant; a plurality of evaporators connected to the flow adjustment part, the plurality of evaporators including a first evaporator and a second evaporator; a first refrigerant passage extending from the flow adjustment part to the first evaporator; a second refrigerant passage extending from the flow adjustment part to the second evaporator; and a guide tube extending from the dryer to one side of at least one evaporator of the plurality of evaporators to guide the refrigerant to be cooled.

The at least one evaporator may include: a refrigerant tube through which the refrigerant flows; and a fixing bracket fixing the refrigerant tube and the guide tube.

The guide tube includes: a tube outlet part connected to one side of the dryer to guide the refrigerant to the at least one evaporator; and a tube inlet part connected to the other side of the dryer to introduce the cooled refrigerant from the at least one evaporator to the dryer.

The refrigerator may further include a check valve disposed in the tube inlet part to restrict a flow of the refrigerant from the tube inlet part to the at least one evaporator.

The dryer may include: a dryer body defining an inner space thereof; at least one filter member disposed in the inner space of the dryer body; and a support part supporting a lower portion of the filter member.

The refrigerator may further include a first space part defined between an inner circumferential surface of the dryer body and an outer circumferential surface of the support part to guide a liquid refrigerant introduced into the dryer downward.

The dryer may further include a vertically movable floating member spaced apart from a lower portion of the support part.

The dryer may include: an inflow hole defined in an upper portion of the dryer to guide the introduction of the refrigerant; and a discharge hole defined in a lower portion of the dryer body to guide discharge of the refrigerant, the discharge hole being selectively opened or closed by the floating member.

The refrigerator may further include: a temperature sensor detecting temperatures of an inlet and outlet of the first evaporator and temperatures of an inlet and outlet of the second evaporator; a memory in which information with respect to a control time according to a variation in amount of refrigerant flowing into the first refrigerant passage or the second refrigerant passage is mapped and stored; and a control unit controlling the supply of the refrigerant into the first and second evaporators on the basis of the information mapped in the memory, wherein a change in control time may be determined on the basis of the information detected by the temperature sensor.

The information with respect to the control time may include: information with respect to a first set-up time at which an amount of refrigerant supplied into the first evaporator increases to prevent the refrigerant from being concentrated into the second evaporator; and information with respect to a second set-up time at which an amount of refrigerant supplied into the second evaporator to prevent the refrigerant from being concentrated into the first evaporator.

The control unit may increase the second set-up time when the refrigerant concentration into the first evaporator is determined and decrease the second set-up time when the refrigerant concentration into the second evaporator is determined according to the information detected by the temperature sensor.

The refrigerator may further include: a first flow rate adjustment part disposed in the first refrigerant passage; and a second flow rate adjustment part disposed in the second refrigerant passage, wherein the information with respect to the control time may include time information with respect to operation states of the flow adjustment part and the first and second flow rate adjustment parts.

An opening degree of the first flow adjustment part may be maintained so that the opening degree of the first flow adjustment part is greater than that of the second flow adjustment part to increase an amount of refrigerant supplied into the first evaporator, and an opening degree of the second flow adjustment part may be maintained so that the opening degree of the second flow adjustment part is greater than that of the first flow adjustment part to increase an amount of refrigerant supplied into the second evaporator.

The refrigerator may further include: a main body defining a storage compartment; a door opening or closing the main body; and a hot line tube guiding the refrigerant passing through the condenser to a front surface of the main body.

The refrigerator may further include: a bypass valve disposed on an inlet-side of the hot line tube to adjust an amount of refrigerant introduced into the hot line tube or an introduction time of the refrigerant; and a bypass tube extending from the bypass valve to the dryer to guide the refrigerant so that the refrigerant bypasses the hot line tube.

In another embodiment, a method for controlling a refrigerator including a compressor compressing a refrigerant, a condenser condensing the refrigerant compressed in the compressor, and a hot line tube guiding the refrigerant passing through the condenser to a front surface of a refrigerator body to prevent dew from being formed includes: detecting external humidity of the refrigerator; and determining whether the detected humidity is above a preset value to adjust an amount of refrigerant flowing into the hot line tube or a flow time of the refrigerant.

When the detected humidity is above the preset value, a bypass valve connected to the hot line tube may be adjusted in opening degree to increase the flow time of the refrigerant introduced into the hot line tube, and when the detected humidity is below the preset value, the bypass valve connected to the hot line tube may be adjusted in opening degree to decrease the flow time of the refrigerant introduced into the hot line tube.

This application is related to U.S. application Ser. No. 14/531,223 filed on Nov. 3, 2014, whose entire disclosure is incorporated herein by reference.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a compressor configured to compress a refrigerant;

a condenser configured to condense the refrigerant compressed in the compressor;

a dryer in which the refrigerant condensed in the condenser is received;

a flow adjustment valve disposed on an outlet-side of the dryer to control a flow direction of the refrigerant;

a plurality of evaporators connected to the flow adjustment valve, the plurality of evaporators including a first evaporator and, a second evaporator;

a first refrigerant passage extending from the flow adjustment valve to the first evaporator;

a second refrigerant passage extending from the flow adjustment valve to the second evaporator; and a guide tube extending from the dryer to one side of at least one evaporator of the first evaporator or the second evaporator to guide the refrigerant to be cooled, the guide tube including:

a tube outlet connected to a first side of the dryer to guide the refrigerant to the at least one evaporator, and a tube inlet connected to a second side of the dryer to introduce the cooled refrigerant in the at least one evaporator to the dryer.

2. The refrigerator according to claim 1, wherein the at least one evaporator comprises a refrigerant tube through which the refrigerant flows, and a bracket fixing the refrigerant tube and the guide tube.

3. The refrigerator according to claim 1, further comprising a check valve provided in the tube inlet part to restrict a flow of the refrigerant from the tube inlet to the at least one evaporator.

4. The refrigerator according to claim 1, wherein the dryer comprises:

a dryer body defining an inner space thereof;

at least one filter member provided in the inner space of the dryer body; and a support configured to support the filter member.

5. The refrigerator according to claim 4, further comprising a first space part defined between an inner circumferential surface of the dryer body and an outer circumferential surface of the support to guide a liquid refrigerant downward into the dryer.

6. The refrigerator according to claim 4, wherein the dryer further comprises a float spaced apart from a lower portion of the support part and being vertically movable.

7. The refrigerator according to claim 6, wherein the dryer comprises:

an inflow hole defined in an upper portion of the dryer body to guide the refrigerant;

a discharge hole defined in a lower portion of the dryer body to guide discharge of the refrigerant, the discharge hole being selectively closed by the float.

8. The refrigerator according to claim 1, further comprising:

a temperature sensor detecting at least one of temperatures of an inlet and outlet of the first evaporator or temperatures of an inlet and outlet of the second evaporator;

a memory in which information with respect to a control time according to a variation in amount of refrigerant flowing into the first refrigerant passage or the second refrigerant passage is mapped and stored; and a controller configured to control the supply of the refrigerant into the first and second evaporators on the basis of the information mapped in the memory, wherein the controller determines whether the control time changes on the basis of the information detected by the temperature sensor.

9. The refrigerator according to claim 8, wherein the information with respect to the control time comprises:

information with respect to a first set-up time at winch an amount of refrigerant supplied into the first evaporator increases to prevent the refrigerant from being concentrated into the second evaporator; and information with respect to a second set-up time at which an amount of refrigerant supplied into the second evaporator increases to prevent the refrigerant from being concentrated into the first evaporator.

10. The refrigerator according to claim 9, wherein the controller increases the second set-up time when the refrigerant concentration into the first evaporator is determined and decreases the second set-up time when the refrigerant concentration into the second evaporator is determined according to the information detected by the temperature sensor.

11. The refrigerator according to claim 8, further comprising:

a first flow rate adjustment valve provided in the first refrigerant passage; and a second flow rate adjustment valve provided in the second refrigerant passage, wherein the information with respect to the control time comprises time information with respect to operation states of the flow adjustment or the first and second flow rate adjustment valves.

12. The refrigerator according to claim 11, wherein the controller controls the first flow adjustment valve such that a degree of opening of the first flow adjustment valve is greater than that of the second flow adjustment part to increase an amount of refrigerant supplied into the first evaporator, and controls the a second flow adjustment valve such that a degree of opening of the second flow adjustment valve is greater than that of the first flow adjustment valve to increase an amount of refrigerant supplied into the second evaporator.

13. The refrigerator according to claim 1, further comprising:

a main body defining a storage compartment;

a door opening or closing the main body; and a line tube guiding the refrigerant passing through the condenser to a front surface of the main body.

14. The refrigerator according to claim 13, further comprising:

a bypass valve disposed on an inlet-side of the line tube to adjust an amount of refrigerant introduced into the line tube or an introduction time of the refrigerant; and a bypass tube extending from the bypass valve to the dryer to allow the refrigerant to bypass the line tube.

15. A refrigerator comprising:

a compressor configured to compress a refrigerant;

a condenser configured to condense the refrigerant compressed in the compressor;

a dryer in which the refrigerant condensed in the condenser is received;

a flow adjustment valve provided on an outlet-side of the dryer to control a flow direction of the refrigerant;

a plurality of evaporators connected to the flow adjustment valve, the plurality of evaporators including a first evaporator and a second evaporator;

a first refrigerant passage extending from the flow adjustment valve to the first evaporator;

a second refrigerant passage extending from the flow adjustment valve to the second evaporator;

a guide tube extending from the dryer to one side of at least one evaporator of the first evaporator or the second evaporator to guide the refrigerant to be cooled;

a temperature sensor detecting temperature of the first evaporator or the second evaporator;

a memory in which information with respect to a control time according to a variation in amount of refrigerant flowing into the first refrigerant passage or the second refrigerant passage is mapped and stored; and a controller configured to control the supply of the refrigerant into the first and second evaporators on the basis of the information mapped in the memory, wherein the information with respect to the control time includes:

information with respect to a first set-up time at which an amount of refrigerant supplied into the first evaporator increases to prevent the refrigerant from being concentrated into the second evaporator; and information with respect to a second set-up time at which an amount of refrigerant supplied into the second evaporator increases to prevent the refrigerant from being concentrated into the first evaporator.

* * * * *